US007143532B2

(12) United States Patent
Lowry

(10) Patent No.: US 7,143,532 B2
(45) Date of Patent: Dec. 5, 2006

(54) MARINE BACKHOE DREDGE

(75) Inventor: Richard Michael Lowry, Naperville, IL (US)

(73) Assignee: Great Lakes Dredge & Dock Company, Oakbrook, IL (US)

( * ) Notice: Subject to any disclaimer, the term of this patent is extended or adjusted under 35 U.S.C. 154(b) by 150 days.

(21) Appl. No.: 10/760,096

(22) Filed: Jan. 15, 2004

(65) Prior Publication Data

US 2005/0172521 A1 Aug. 11, 2005

(51) Int. Cl.
*E02D 17/16* (2006.01)

(52) U.S. Cl. ..... 37/345; 37/309

(58) Field of Classification Search ..... 37/307, 37/309, 312, 341, 345
See application file for complete search history.

(56) References Cited

U.S. PATENT DOCUMENTS

| | | | | |
|---|---|---|---|---|
| 659,489 | A | | 10/1900 | Osgood |
| 776,124 | A | | 11/1904 | Dutton |
| 776,125 | A | | 11/1904 | Dutton |
| 919,498 | A | * | 4/1909 | Turner ..... 37/341 |
| 1,047,233 | A | * | 12/1912 | Jackson ..... 37/307 |
| 1,549,508 | A | * | 8/1925 | Robinson ..... 212/309 |
| 1,915,331 | A | | 6/1933 | Neveling |
| 2,271,344 | A | | 1/1942 | Rauch ..... 37/73 |
| 2,569,458 | A | * | 10/1951 | Davidson ..... 414/690 |
| 2,640,284 | A | | 6/1953 | Nielsen ..... 37/71 |
| 2,944,352 | A | | 7/1960 | Kaufmann ..... 37/54 |
| 3,086,305 | A | | 4/1963 | West ..... 37/73 |
| 3,926,301 | A | * | 12/1975 | Herms ..... 198/509 |
| 4,676,052 | A | | 6/1987 | Hawk ..... 56/8 |
| 5,435,083 | A | * | 7/1995 | Thompson ..... 37/341 |
| 6,823,616 | B1 | | 11/2004 | Gutter et al. ..... 37/461 |

* cited by examiner

*Primary Examiner*—Meredith C. Petravick
(74) *Attorney, Agent, or Firm*—Winston & Strawn LLP

(57) ABSTRACT

A marine backhoe dredge having a counterbalancing system that increases the hoisting capacity and hoisting speed of the backhoe. The device includes a backhoe mounted on a vessel and a counterbalancing system that includes an adjustable support structure, one or more cables operatively associated with the support structure and backhoe, and connected to a counterbalance such as a counterweight or a winch.

21 Claims, 4 Drawing Sheets

MARINE BACKHOE DREDGE

BACKGROUND OF THE INVENTION

1. Field of the Invention

The present invention relates to a marine backhoe dredge for excavation and mining applications under water. In particular, the present invention is directed to a sub-aqueous backhoe dredge which includes a counterbalancing system that increases the hoisting capacity and/or the hoisting speed of the backhoe.

2. Description of Related Art

A variety of hydraulic excavators, also called backhoe dredges, are known for hoisting hard in-situ and pretreated materials. A backhoe dredge typically includes a rotating frame and an attachment assembly consisting of a monoblock boom, stick and bucket. For example, U.S. Pat. No. 4,676,052 to Hawk discloses a self-propelled dredge which includes a two-piece boom and sealed bucket for removing silt, muck, and plant growth from the bottom of lakes, and ponds, whereas U.S. Pat. No. 3,086,305 to West discloses a dredge which includes a barge having a crane unit mounted thereon and spuds pivotably mounted to the barge.

Hydraulic excavators were originally used for land operations in which the excavated material was hoisted only through one medium, air. In contrast, marine backhoe dredges are required to hoist excavated material through two media, initially water, then air. Due to well-known principles of buoyancy, a backhoe has a greater hoisting capacity while submerged under water, than it does when hoisting loads in an air-medium. Due to this disparity in hoisting capabilities, problems often arise. Simply, the marine borne backhoe dredge often times hoists an excavated load in the water medium that actually exceeds its hoisting capacity in an air medium. In this regard, the backhoe is not sufficient for hoisting the excavated load when the backhoe emmerges from the water surface into the air medium.

Presently, when a backhoe with a greater hoisting capacity is needed to excavate or mine heavily compacted materials, a larger sized backhoe must be utilized in order to hoist the heavy material. One of the drawbacks of having to substitute the backhoe dredge with a larger sized backhoe is that current hydraulic technology cannot be further scaled to larger sized loads. In other words, current hydraulic technology dictates and limits the maximum size of a backhoe. Therefore, if the maximum sized backhoe dredge still lacks the capacity to hoist the load, little alternatives for excavating heavy loads exist.

Thus, there remains a need for an efficient and alternative apparatus that has an increased hoisting capacity and hoisting speed of the current backhoe dredges and is not limited by current hydraulic technology. The present invention now seeks to resolve these problems.

SUMMARY OF THE INVENTION

The invention relates to a marine backhoe dredge, comprising a vessel; a backhoe movably mounted on the vessel, the backhoe including a boom, a stick, and a bucket; and a counterbalancing system to increase hoisting capacity or hoisting speed of the backhoe. The counterbalancing system includes a support structure mounted to the vessel, a counterbalance, and one or more cables operatively associated with the support structure, counterbalance and backhoe and being connected to the backhoe and counterbalance. Advantageously, each of the boom, stick, and bucket of the backhoe is hydraulically driven by a hydraulic system with independent actuators. In addition, each of the boom, stick, and bucket is pivotable and has an independent range of motion. The backhoe is preferably mounted to the vessel by a pedestal mount, a turntable mount or a track mount. In this regard, the backhoe has a broad range of motion, which includes side-to-side movement, and up-and-down movement.

The counterbalance is preferably a winch that collects or releases the one or more cables as the backhoe is operated, or a counterweight movably mounted on the vessel to collect or release the cable as the backhoe is operated. Also, the support structure can be pivotable and in operative association with the backhoe. A preferred support structure is an A-frame assembly that includes at least one tie-back cable attached to the adjustable support structure and anchored to the vessel for stability. The at least one tie-back cable is preferably a wire rope having a diameter between about 1 to 3 inches so that the at least one tie-back cable is capable of accommodating a backstay load of between about 200 KIPS.

The bucket advantageously has a capacity of between about 5 to 35 cubic yards so that the backhoe dredge has a capacity to mine a channel or trench having a depth of up to about 85 feet. In addition, a plurality of spuds can be provided to inhibit movement of the vessel during operation of the backhoe. The plurality of spuds are operable in the vertical direction with respect to the watercraft, the distal end of the plurality of spuds engaging the bottom or floor of the waterway to be excavated and/or mined by the backhoe dredge. Preferably, at least three spuds are provided in operative association such that at least one spud is maintained in a fixed position while the backhoe is operating, and at least one spud is configured to stabilize the vessel in one position but allow advancing of the vessel in another position.

It is to be understood that both the foregoing general description and the following detailed description are exemplary and are intended to provide further explanation of the invention claimed.

BRIEF DESCRIPTION OF THE DRAWINGS

The accompanying drawings, which are incorporated herein and constitute part of this specification, are included to illustrate and provide a further understanding of the apparatus and system of the invention. Together with the description, the drawings serve to explain the principles of the invention. In these drawings.

DETAILED DESCRIPTION OF THE PREFERRED EMBODIMENTS

Figure 1:
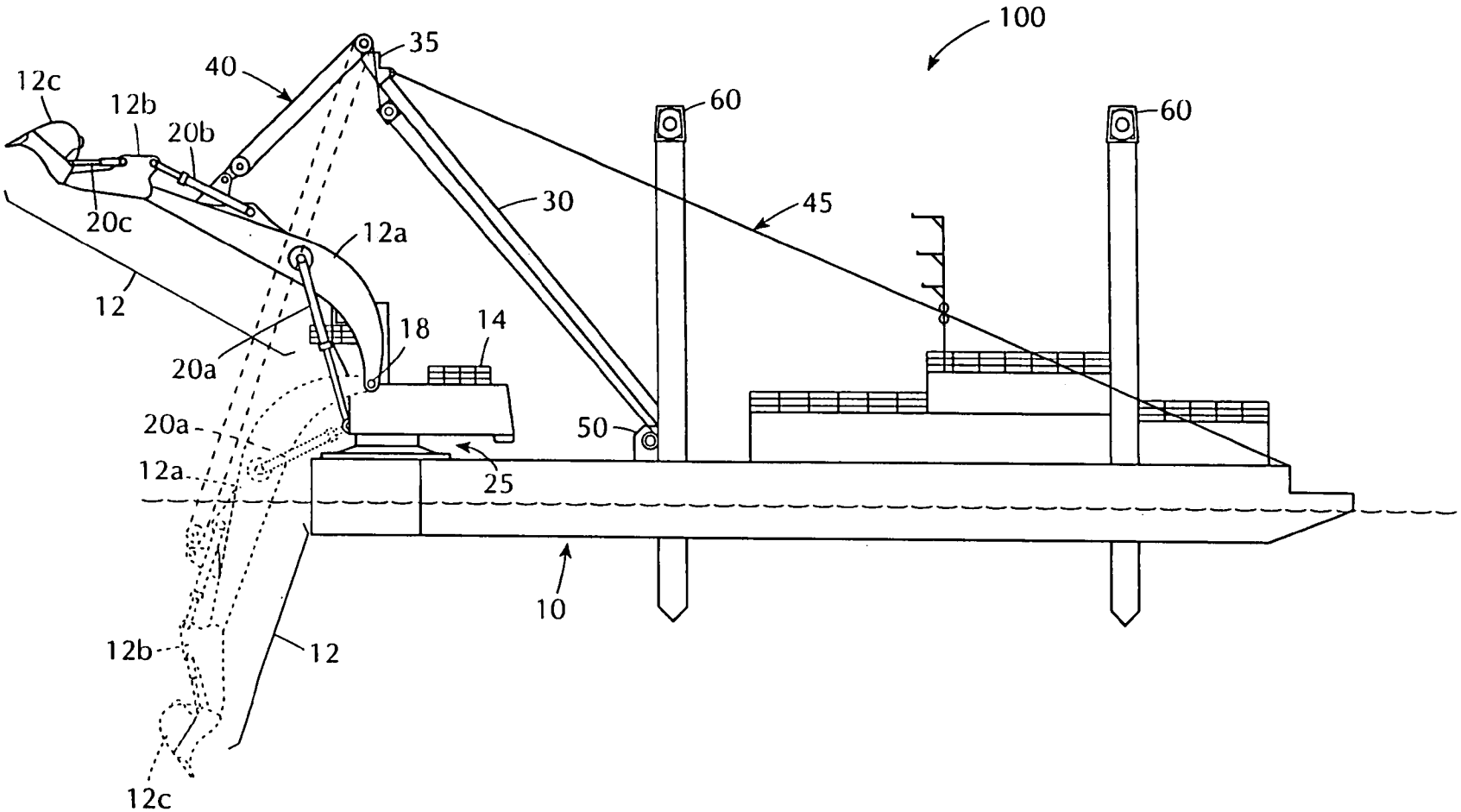
FIG. 1 is a schematic representation of the backhoe dredge including a vessel, a backhoe, and a counterbalancing system including a winch.

The purpose and advantages of the present invention will be set forth in and will become apparent from the description that follows, as well as will be learned by practice of the invention. Additional advantages of the invention will be realized and attained by the systems particularly pointed out in the written description and claims hereof, as well as from the appended drawings.

To achieve these and other advantages and in accordance with the purpose of the invention, as embodied and broadly described, the invention includes a backhoe dredge for dredging heavily compacted materials including but not limited to rock, blasted rock, and clay from the bottom of waterways. The backhoe dredge is also used for underwater mining including the deepening and widening or otherwise forming of channels and/or trenches on the floor of the waterway. The term "waterway" as used herein includes but is not limited to oceans, harbors, seas, lakes, rivers, estuaries, and other bodies of water that can accommodate the size of the backhoe dredge of the invention. The term "backhoe" as used herein refers to an excavator including a movably mounted bucket mounted to the distal end of an extension arm or to a movably mounted stick. The term "dredge" as used herein refers to any of various machines equipped with scooping or suction devices, and is used to excavate material, to deepen and/or widen waterways, and in underwater mining.

Reference will now be made in detail to the present preferred embodiments of the invention, examples of which are illustrated in the accompanying drawings.

The backhoe dredge generally comprises a vessel, a hydraulically-driven backhoe movably mounted to the vessel, and a counterbalancing system that increases the hoisting capacity and/or the hoisting speed of the backhoe. The term "vessel" as used herein refers to a craft capable of being navigated on water. The overall weight of the boom, stick, and bucket is between about 50 to 300 tons.

The backhoe is movably mounted on the vessel so that it has a free range of motion in the at least two directions. The backhoe advantageously includes a boom segment, a stick segment, and a bucket. Preferably, the boom, the stick, and the bucket are each hydraulically-driven, with each having a hydraulic system with independent actuators. Advantageously, each of the boom segment, the stick segment, and the bucket have a range of motion in at least two directions. Preferably, the range of motion of each section is independent of the others.

The counterbalancing system includes an adjustable support structure mounted on the vessel, with one or more cables operatively associated with the adjustable support structure. The one or more cables are advantageously connected to a counterbalance that is mounted on the vessel. Generally, the support structure is adjustable according to the position of the backhoe. The one or more cables are operatively attached to support structure, and preferably are one or more wire ropes. The adjustable support structure is operatively attached to the boom of the backhoe.

Additionally, at least one tie-back cable is utilized to "tie-back" the adjustable support structure such that the adjustable support member forms an angle with the vessel. In this regard, the tie-back cable is attached to the adjustable support structure and to the vessel. The counterbalance preferably comprises a winch or a counterweight. When the counterbalancing structure is a counterweight, it is located in a housing mounted to or upon the vessel. The counterbalancing system provides the backhoe dredge with increased hoisting capacity and/or hoisting speed and does not suffer from the limitations imposed by the hydraulic capacity of the vessel. Thus, the backhoe dredge of the invention is more suitable for hoisting very heavy materials, such as rock, concrete, blasted rock, clay and other heavily compacted materials.

In accordance with another aspect of the invention, the backhoe dredge comprises a water craft, a hydraulically-driven backhoe that is movably mounted to the water craft, and a counterbalancing system that increases the hoisting capacity and/or the hoisting speed of the backhoe. The backhoe of this aspect of the invention includes an extension arm having an open bucket movably attached to the distal end of the extension arm. The dimensions of the bucket are in the order of about 5 to 35 cubic yards, and the backhoe dredge has a hoisting capacity sufficient to hoist about 7 to 50 tons of dredging material.

The apparatus presented herein may be used for purposes including dredging or excavating material from the bottom of a waterway; deepening and widening channels; and/or underwater mining. The, present invention is particularly suited for dredging heavily compacted materials including but not limited to rock, blasted rock, clay, and the like. For purpose of explanation and illustration, and not limitation, an exemplary embodiment of the system in accordance with the invention is shown in FIG. 1 and is designated generally by reference character 100.

As shown in FIG. 1, the backhoe dredging system 100 generally includes a vessel 10, a backhoe 12 movably or pivotably mounted onto the vessel, and a counterbalancing system 14 to increase the hoisting capacity and/or the hoisting speed of the backhoe dredge.

Specifically, and in accordance with the present invention, the vessel 10 embodied herein is a water craft capable of being navigated on water.

Figure 2:
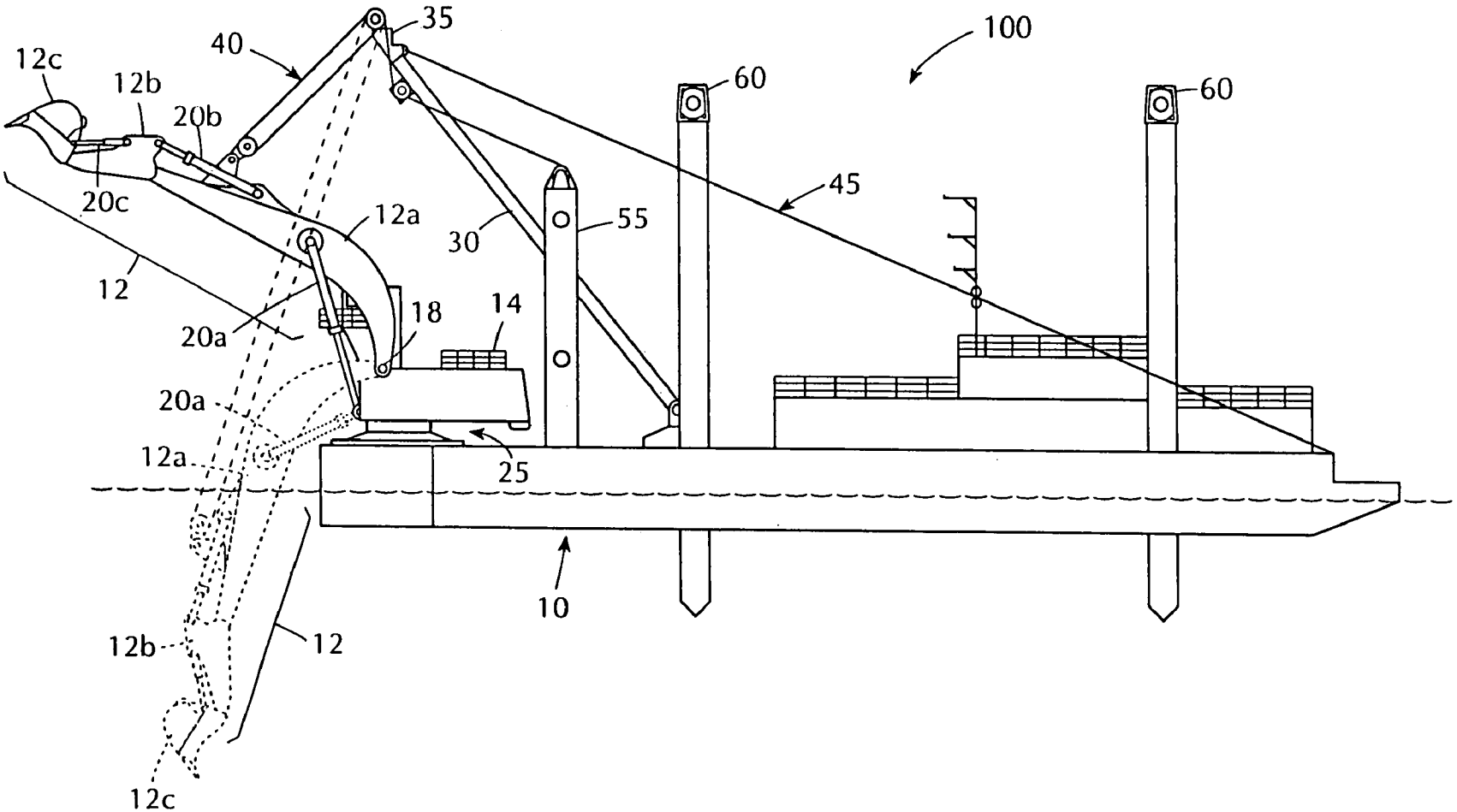
FIG. 2 is a schematic representation of the backhoe dredge including a vessel, a backhoe, and a counterbalancing system including a counterweight housed in a tower housing.

The backhoe 12 of the present invention is movably or pivotably mounted on the vessel 10 and includes a boom 12*a*, a stick 12*b*, and a bucket 12*c*. As shown in FIG. 1, the backhoe is pivotably mounted 18 to the vessel by a pedestal mount 25. However, other mounting techniques can also be used including but not limited to a turntable mount, a tracking mount, or any other type of mount that provides the backhoe with a suitable range of motion for excavating, mining, and channel-forming or trench-forming applications. Preferably, the backhoe is mounted to the vessel by a turntable. As also shown in FIGS. 1 and 2, stick 12*b* is movably mounted to the distal end of the boom 12*a*, and the bucket 12*c* is movably mounted to the stick 12*b*. Thus, each of 12*a*, 12*b*, and 12*c* of the backhoe has an independent range of motion, thus providing a wide range of excavating movement to the backhoe.

As shown in FIGS. 1 and 2, the backhoe includes three sets of hydraulic actuators 20*a*, 20*b*, 20*c*, which correspond to boom 12*a*, stick 12*b*, and bucket 12*c* of the backhoe, respectively. Hydraulic actuator 20*a* hydraulically drives the boom segment of the backhoe, hydraulic actuator 20*b* drives the stick segment of the backhoe, and hydraulic actuator 20*c* drives the bucket segment of the backhoe. Utilization of separate hydraulic actuators for each of the boom 12*a*, stick 12*b*, and bucket 12*c* provides controlled range of motion for each of the boom, stick and bucket of the backhoe.

Figure 3:
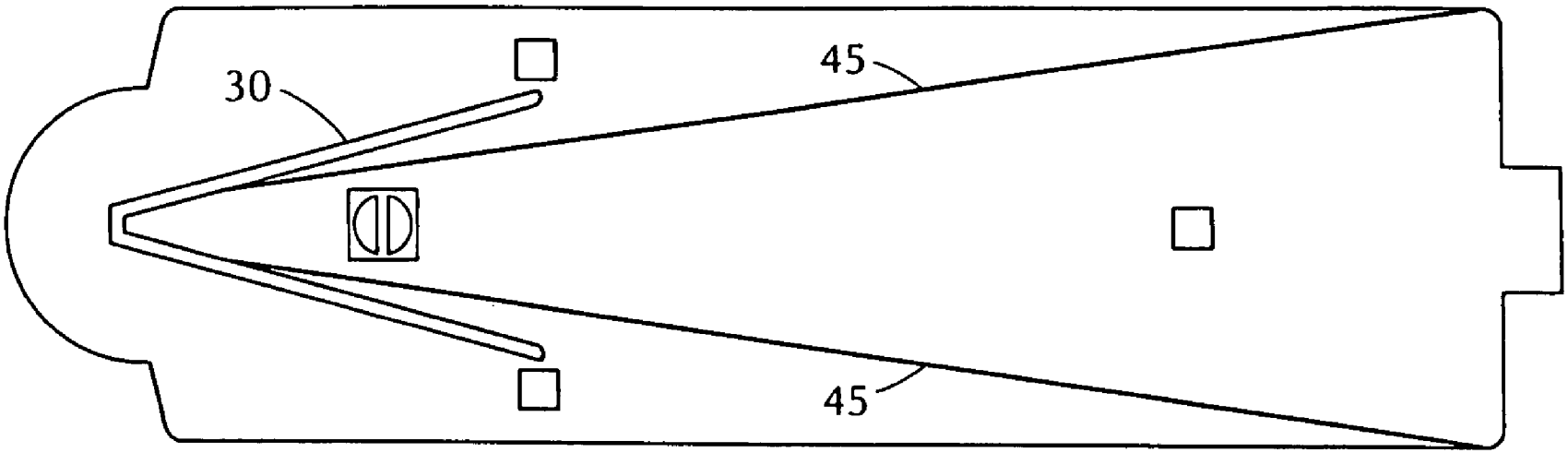
FIG. 3 is a top plan view of the backhoe dredge of FIGS. 1 and 2 illustrating an A-frame support structure with tie-back cables.
Figures 4, 4A:
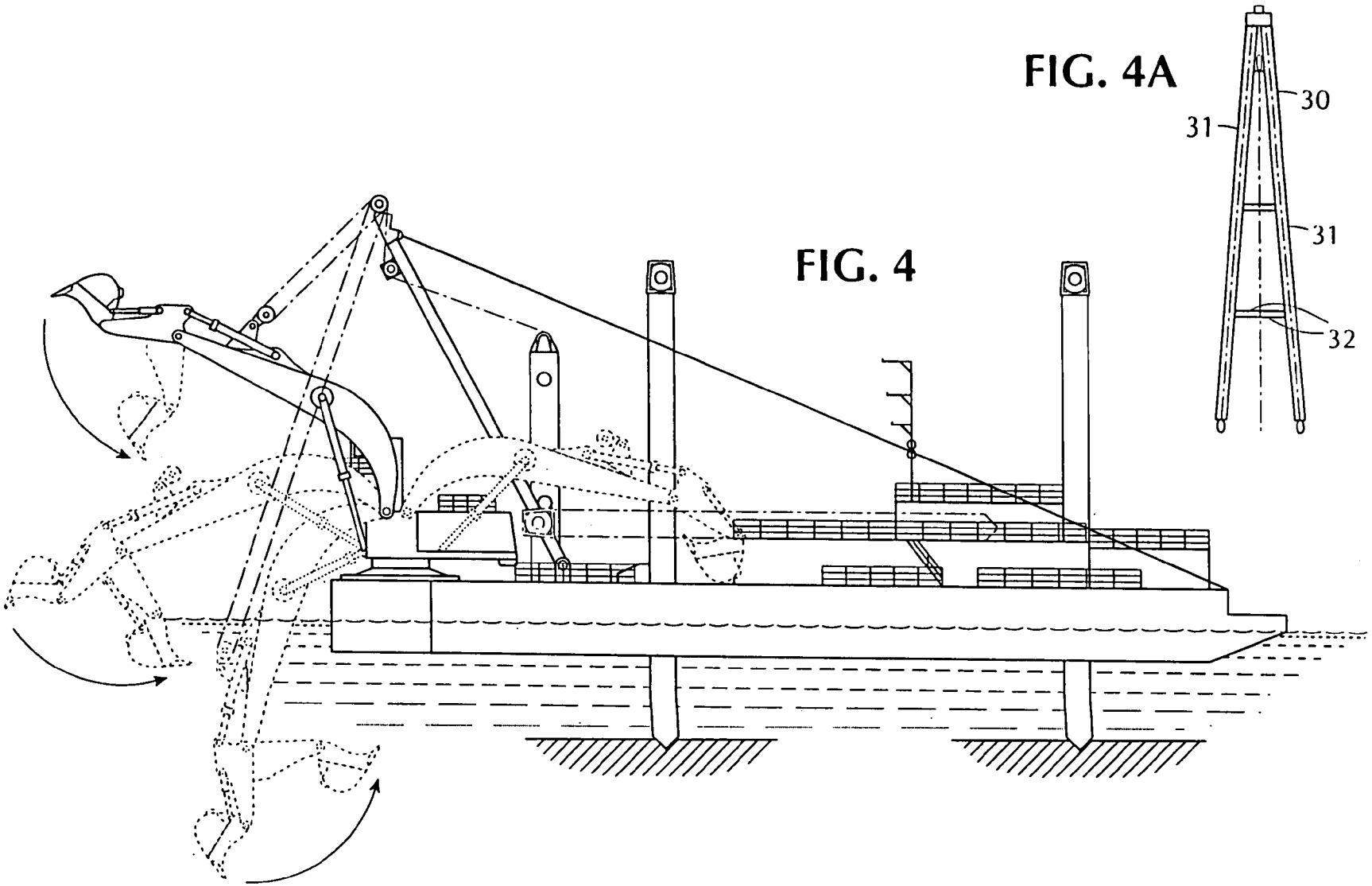
FIG. 4 is an elevation view of the backhoe dredge showing movement of the backhoe in phantom.
FIG. 4A is a top view of the A frame support structure.

The counterbalancing system of the present invention includes an adjustable support structure 30, one or more cables 40, 45 operatively associated with the adjustable support structure, and a counterbalance 50 mounted to the vessel 10. As best illustrated in FIG. 3, the adjustable support structure is preferably an "A-frame" assembly 30 mounted to the vessel 10. Referring to FIG. 4, the marine backhoe dredge affixed to the watercraft has a range of motion depicted in phantom. FIG. 4A, illustrates a support structure, preferably an A-frame assembly 30, which is preferably formed of first and second metal pipes 31, generally of high strength steel, and third and fourth metal pipes 32, also of high strength steel.

The support structure 30 is pivotably mounted to the vessel 10, and is adjustable in relation to the backhoe position. Preferably, the adjustable support structure 30 is affixed to at least one tie-back cable 45, which is anchored to the vessel 10, as can be seen in FIGS. 1, 2 and 3. Preferably, the at least one tie-back cable 45 is a wire rope having a diameter of about 1 to 3 inches. Preferably, the at least one tie-back cable 45 accommodates a backstay load of about 200 KIPS. The unit KIPS as used herein refers to a unit of weight equal to 1,000 pounds or 455 kilograms.

Cable 40 is operatively associated with the support structure 30 and the backhoe 12. Preferably, the cable is operatively associated at an intermediate point 15 on the backhoe, and to a distal point 35 on the support structure 30. The support structure 30 and the backhoe 12 preferably include cable attachment means to operatively attach the cable 40 to the support structure 30 and the backhoe 12. Cable attachment means include but are not limited to an aperture, ring, pulley, block, drum, or other means capable of receiving cable 40 such as, for example, reeving, winding or wrapping the cable through or around or about the attachment means.

As shown in FIG. 1, a counterbalance system 14 is mounted on vessel 10. The counterbalance may be a winch 50 as shown in FIG. 1 or a counterweight assembly, as shown in FIG. 2. Preferably, the counterweight weight assembly includes a counterweight housed in a tower 55 or other housing as shown in FIG. 2. During operation of the backhoe, the counterbalance is tightened to support the weight of the boom, stick, bucket, and load. The cable is collected or played out as the backhoe is operated using the winch 50 or by vertical counterweight movement in the tower 55. By this arrangement, the backhoe can lift and move greater amounts of material thus increasing the efficiency of operation of the apparatus. This allows greater bucket sizes to be implemented than if the hydraulic drives are used alone.

Preferably, the backhoe dredge includes a plurality of spuds 60 to stabilize the vessel and prevent movement of the vessel during operation of the backhoe dredge. Preferably, the plurality of spuds are independently vertically operable. In operation, the plurality of spuds engage the floor or bed of the waterway so that the vessel is stabilized. The construction of the plurality of spuds can include a pointed engaging member to engage the floor of the waterway and become at least partially embedded in the floor of the waterway to help prevent movement of the vessel during operation of the backhoe. Alternatively or additionally, anchors can be used to help prevent movement of the vessel during operation of the backhoe dredge.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents.

What is claimed is:

1. A marine backhoe dredge, comprising:

a vessel;

a backhoe movably mounted on the vessel, the backhoe including a boom, a stick, and a bucket wherein each of the boom, stick, and bucket is pivotable and has an independent range of motion; and a counterbalancing system to increase hoisting capacity or hoisting speed of the backhoe, the counterbalancing system including a support structure mounted to the vessel, a counterbalance, and one or more cables operatively associated with the support structure, counterbalance and backhoe and being connected to the backhoe and counterbalance.

2. The backhoe dredge of claim 1, wherein each of the boom, stick, and bucket of the backhoe is hydraulically driven by a hydraulic actuator.

3. The backhoe dredge of claim 1, wherein the backhoe is mounted to the vessel by a pedestal mount, a turntable mount or a track mount.

4. The backhoe dredge of claim 1, wherein the counterbalance is a winch that collects or releases the one or more cables as the backhoe is operated.

5. The backhoe dredge of claim 1, wherein the counterbalance structure is a counterweight movably mounted on the vessel to collect or release the cable as the backhoe is operated.

6. The backhoe dredge of claim 1, wherein the counterbalancing system support structure is an A-frame assembly.

7. The backhoe dredge of claim 1, further including at least one tie-back cable attached to the counterbalancing system support structure and anchored to the vessel.

8. The backhoe dredge of claim 7, wherein the at least one tie-back cable is a wire rope having a diameter of between about 1 to 3 inches.

9. The backhoe dredge of claim 7, wherein the at least one tie-back cable is capable of accommodating a backstay load of between about 200 KIPS.

10. The backhoe dredge of claim 1, wherein the boom, stick and bucket weighs between about 50 to 300 tons, wherein the bucket has a capacity of between about 5 to 35 cubic yards so that the backhoe dredge has a capacity to mine a channel or trench having a depth of up to about 85 feet.

11. The backhoe dredge of claim 1, further comprising a plurality of spuds to inhibit movement of the vessel during operation of the backhoe.

12. The backhoe dredge of claim 11, wherein at least three spuds are provided in operative association such that at least one spud is maintained in a fixed position while the backhoe is operating, and at least one spud is configured to stabilize the vessel in one position but allow advancing of the vessel in another position.

13. The backhoe dredge of claim 1, wherein:

the vessel is a water craft;

the backhoe is a hydraulically driven backhoe movably mounted to the water craft; and the counterbalancing system comprises an A-frame assembly mounted to the watercraft, one or more cables, and a counterbalance mounted upon the water craft, the one or more cables operatively associated to the backhoe, counterbalance and the A-frame support structure, and being connected between the backhoe and counterbalance, wherein the counterbalance is a counterweight and tower arrangement that collects or releases the one or more cables as the backhoe is operated by vertical movement of the counterweight in the tower, the backhoe has a bucket capacity of about 5 to 35 cubic yards, and the dredge a dredging depth capacity of up to about 85 feet.

14. The backhoe dredge of claim 13, wherein the water craft is a barge and further including at least one tie-back cable attached to the A-frame assembly and anchored to the vessel, with the at least one tie-back cable being a wire rope having a diameter between about 1 to 3 inches so that the at least one tie-back cable is capable of accommodating a backstay load of between about 200 KIPS.

15. The backhoe dredge of claim 14, wherein the extension arm and bucket weigh between about 50 to 300 tons and further including a plurality of spuds to inhibit movement of the water craft during operation of the backhoe dredge, wherein at least three spuds are provided in operative association such that at least one spud is maintained in a fixed position while the backhoe is operating, and at least one spud is configured to stabilize the barge in one position but allow advancing of the vessel in another position.

16. A marine backhoe dredge comprising:

a vessel;

a backhoe movably mounted on the vessel, the backhoe including a boom, a stick, and a bucket; and a counterbalancing system to increase hoisting capacity or hoisting speed of the backhoe, the counterbalancing system including a support structure mounted to the vessel, a counterbalance, and one or more cables operatively associated with the support structure, counterbalance and backhoe and being connected to the backhoe and counterbalance;

wherein the counterbalancing system support structure is pivotable and in operative association with the backhoe.

17. The backhoe dredge of claim 14, wherein the counterbalance is a winch that collects or releases the one or more cables as the backhoe is operated.

18. The backhoe dredge of claim 16, wherein the counterbalance structure is a counterweight movably mounted on the vessel to collect or release the cable as the backhoe is operated.

19. A marine backhoe dredge comprising:

a water craft;

a hydraulically driven backhoe movably mounted to the water craft, the backhoe including an extension arm having a bucket pivotably attached to a distal end of the extension arm; and a counterbalancing system for increasing hoisting capacity or hoisting speed of the backhoe, the counterbalancing system including an A-frame assembly mounted to the watercraft, one or more cables, and a counterbalance mounted upon the water craft, the one or more cables operatively associated to the backhoe, counterbalance and the A-frame support structure, and being connected between the backhoe and counterbalance, wherein the counterbalance is a winch that collects or releases the one or more cables as the backhoe is operated and the backhoe has a bucket capacity of about 5 to 35 cubic yards, and a dredging depth capacity of up to about 85 feet.

20. The backhoe dredge of claim 19, wherein the water craft is a barge and further including at least one tie-back cable attached to the A-frame assembly and anchored to the vessel, with the at least one tie-back cable being a wire rope having a diameter between about 1 to 3 inches so that the at least one tie-back cable is capable of accommodating a backstay load of between about 200 KIPS.

21. The backhoe dredge of claim 20, wherein the extension arm and bucket weigh between about 50 to 300 tons and further including a plurality of spuds to inhibit movement of the water craft during operation of the backhoe dredge, wherein at least three spuds are provided in operative association such that at least one spud is maintained in a fixed position while the backhoe is operating, and at least one spud is configured to stabilize the barge in one position but allow advancing of the vessel in another position.

* * * * *

UNITED STATES PATENT AND TRADEMARK OFFICE

CERTIFICATE OF CORRECTION

PATENT NO. : 7,143,532 B2
APPLICATION NO. : 10/760096
DATED : December 5, 2006
INVENTOR(S) : Lowry It is certified that error appears in the above-identified patent and that said Letters Patent is hereby corrected as shown below:

Column 7:
Line 27 (claim 17, line 1), after "The backhoe dredge of claim" delete "14" and insert -- 16 --.

Signed and Sealed this

Twenty-third Day of January, 2007

JON W. DUDAS
*Director of the United States Patent and Trademark Office*